US008869482B2

(12) United States Patent
Hunke

(10) Patent No.: US 8,869,482 B2
(45) Date of Patent: Oct. 28, 2014

(54) GAP PROFILE FOR MOVEMENT GAP

(71) Applicant: Stefan Hunke, Wuppertal (DE)

(72) Inventor: Stefan Hunke, Wuppertal (DE)

(73) Assignee: MIGUA Fugensysteme GmbH & Co. KG, Wuelfrath (DE)

( * ) Notice: Subject to any disclaimer, the term of this patent is extended or adjusted under 35 U.S.C. 154(b) by 0 days.

(21) Appl. No.: 13/955,379

(22) Filed: Jul. 31, 2013

(65) Prior Publication Data

US 2014/0157703 A1 Jun. 12, 2014

(30) Foreign Application Priority Data

Aug. 28, 2012 (DE) ..... 10 2012 107 901

(51) Int. Cl.
*E04B 1/68* (2006.01)
*E04B 5/00* (2006.01)
*E01D 19/06* (2006.01)

(52) U.S. Cl.
CPC . *E04B 5/00* (2013.01); *E04B 1/681* (2013.01); *E01D 19/06* (2013.01)
USPC ..... 52/395

(58) Field of Classification Search
CPC ..... E04B 1/681
USPC ..... 52/393–395, 396.04, 396.05, 398.07, 52/396.08, 396.09, 396.1, 459, 461, 52/463–468; 404/47, 49, 51
See application file for complete search history.

(56) References Cited

U.S. PATENT DOCUMENTS 3,750,359 A * 8/1973 Balzer et al. ..... 52/468
3,888,599 A * 6/1975 Reifsnyder ..... 404/69
4,290,713 A * 9/1981 Brown et al. ..... 404/69
4,378,176 A * 3/1983 Puccio ..... 404/69
4,423,979 A * 1/1984 Brown ..... 404/69
4,537,003 A * 8/1985 Huber et al. ..... 52/396.05
4,615,161 A * 10/1986 Mileham ..... 52/396.07
4,823,452 A * 4/1989 Cloutier ..... 29/235
4,885,885 A * 12/1989 Gottschling ..... 52/396.05
4,901,495 A * 2/1990 Gottschling ..... 52/396.05
5,384,996 A * 1/1995 Nicholas ..... 52/468
6,357,192 B1 * 3/2002 Schluter ..... 52/459
2002/0059764 A1 * 5/2002 Schluter ..... 52/396.04

FOREIGN PATENT DOCUMENTS

DE 10 2007 051 426 A1 4/2009
EP 2497877 A1 * 9/2012

* cited by examiner

*Primary Examiner* — William Gilbert
*Assistant Examiner* — Beth Stephan
(74) *Attorney, Agent, or Firm* — Von Rohrscheidt Patents

(57) ABSTRACT

A gap profile for a movement gap between two parallel building elements of the building including two anchor units for anchoring a gap profile at building elements, each of the anchor units including a circular arc shaped concave joint socket extending in a longitudinal direction of a movement gap; and a bridge unit for bridging the movement gap between the anchor units, the bridge unit including two longitudinally extending circular arc shaped joint heads, wherein the bridge unit is pivotably linked through the joint heads in the joint sockets so that a load impacting the bridge unit perpendicular to a surface of a building is transferred through the joint heads into the joint sockets and from the anchor units into the building elements, wherein the form-locking connection prevents a linear movement of the joint heads relative to the respective joint sockets transversal to the longitudinal direction.

7 Claims, 2 Drawing Sheets

GAP PROFILE FOR MOVEMENT GAP

RELATED APPLICATIONS

Figure 1:
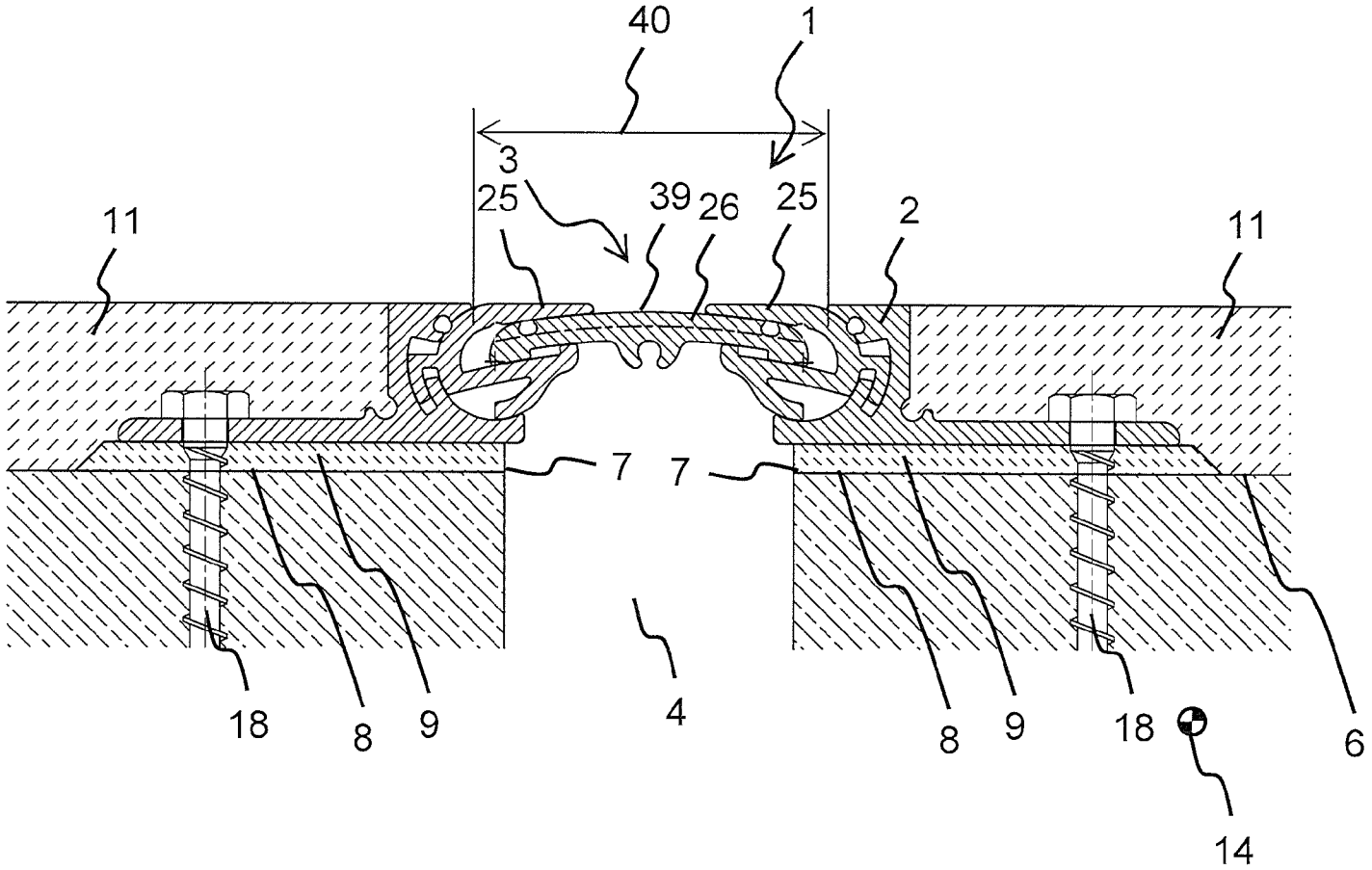

This application claims priority from and incorporates by reference German patent application DE 10 2012 107 901.3, filed on Aug. 28, 2012 which is incorporated in its entirety by this reference.

FIELD OF THE INVENTION

The invention relates to a gap profile for a movement gap in a surface of a building.

BACKGROUND OF THE INVENTION

A gap profile of this general type is known from the product line "FS100" in the program of the applicant configured as a gap arrangement that is symmetrical to a longitudinal direction of the gap for highly loaded floor surfaces. The joint sockets of the known gap profile envelop the joint heads so that they are connected with the joint heads in a form-locking manner. A drivable surface of the gap profile forms a straight teething at the joint heads which straight teething is slideable transversal to the longitudinal direction and supported on a center plate that is supported movable in a linear manner at the joint heads. In the known gap profile the rotation point of the joint configuration is proximal to the support points of the center plate at the joint heads which influences a mechanical loading to the joint heads advantageously.

When building elements are not exactly arranged at identical levels a gap profile which bridges a movement gap is arranged at a slant angle. In this slanted orientation a step is formed in the useable surface of the known gap profile between the lower arranged anchor unit and the joint head supported therein, wherein the step contributes to increased wear of the gap profile in particular when driven over by heavy commercial vehicles.

A publication document DE 10 2007 051 426 A1 that is based on a prior invention by the applicant discloses a gap profile with a pivotable socket support for the bridge unit wherein a load impacting the bridge unit is conducted through a groove in the joint head to a support profile reaching from the joint socket into the joint head. The joint head is pivotably connected to the joint socket through the support profile, wherein the joint socket envelopes the joint head in a circular arc with less than 180°.

BRIEF SUMMARY OF THE INVENTION

It is an object of the invention to provide an improved gap profile. Based on the known gap profile it is proposed according to the invention that the form-locking connection is formed by hook shaped support elements extending in longitudinal direction at the joint heads and by grooves in the joint sockets which grooves have hook shaped under cuts and which are engaged by the support elements. The support element protruding from the joint head and engaging the joint socket reverses the principle of form-locking connection of DE 10 2007 051 426 A1 and facilitates an embodiment of the joint head that implements materials savings.

The object is advantageously achieved by a gap profile for a movement gap in a surface of a building between two parallel building elements of the building including two anchor units for anchoring a gap profile at building elements, each of the anchor units including a circular arc shaped concave joint socket extending in a longitudinal direction of a movement gap; and a bridge unit for bridging the movement gap between the anchor units, the bridge unit including two longitudinally extending circular arc shaped joint heads, wherein the bridge unit is pivotably linked through the joint heads in the joint sockets so that a load impacting the bridge unit perpendicular to a surface of a building is transferred through the joint heads into the joint sockets and from the anchor units into the building elements, wherein the form-locking connection prevents a linear movement of the joint heads relative to the respective joint sockets transversal to the longitudinal direction, and wherein the form-locking connection is provided by hook shaped support elements extending in a longitudinal direction at the joint heads and by hook shaped undercut grooves in the joint sockets which hook shaped undercut grooves are engaged by the hook shaped support elements.

Advantageously a flat useable surface of the gap profile transitions into a circular arc shaped joint surface of the joint heads respectively in a tangential manner in a gap profile according to the invention. The tangentially connecting useable surface avoids a step towards the anchor unit also when the bridge unit is placed at a slant angle.

Preferably the joint sockets envelop the joint heads respectively with a circular arc of 180° or less in a gap profile according to the invention. Compared to the known gap profile from the "FS100" product line the load bearing joint socket and thus material requirements for the anchor unit are reduced.

Particularly advantageously the bridge unit includes a center plate that extends in longitudinal direction in a gap profile according to the invention, wherein the center plate is supported so that it is moveable transversal to the longitudinal direction at least at one of the joint heads in a groove extending in longitudinal direction. A center plate of this type that is movable in a linear manner that is also disclosed in the known gap profiles facilitates compensating movements of the building elements in the surface of the building transversal to the movement gap.

In an advantageous embodiment of the gap profile of this type the center plate is cambered in a circular arc. Loading an arc generates spreading forces at the supports which are oriented in outward direction. In the gap profile known in the art a lever arm is respectively arranged between an axis of the center plate and the pivots points of the joints, wherein spreading forces when passing over the joint generate inner tensions in the gap profile. In the gap profile according to the invention, however, the axis of the center points extends through the pivot points, which prevents a lever arm. Any loading presses the joint heads into the joint sockets in an optimum manner. A gap profile of this type according to the invention furthermore facilitates a straight teething at the joint heads that overlaps the center plate and is internally slideable.

A cover portion of the joint head that reaches over the center plate preferably tapers in a conical manner at a gap profile of this type according to the invention. This substantially avoids a step in the useable surface of the gap profile between the joint head and the center plate.

Advantageously a gap profile according to the invention includes a receiving element at the center plate for receiving a connection element, wherein the center plate is connectable with another center plate of another similar gap profile through the connection element. By the connecting the center plates of adjoining gap profile steps between the gap profiles are substantially avoided.

Advantageously a visible surface of the gap profile that is visible in installed condition is mirror symmetrical to the longitudinal direction. A "symmetrical" gap profile is in particular optically very appealing.

Alternatively non symmetrical gap profiles according to the invention are used that have visible surfaces that are not mirror symmetrical to the longitudinal direction where the building elements on both sides of the gap do not have a mirror symmetrical geometry, for example when bridging gaps at wall connections.

BRIEF DESCRPTION OF THE DRAWINGS

Figure 2:
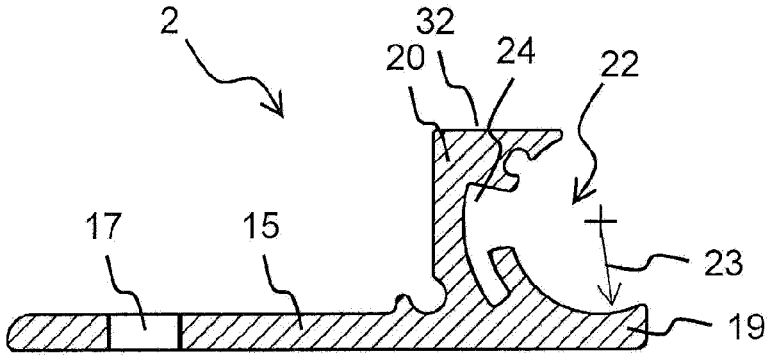
Figure 3:
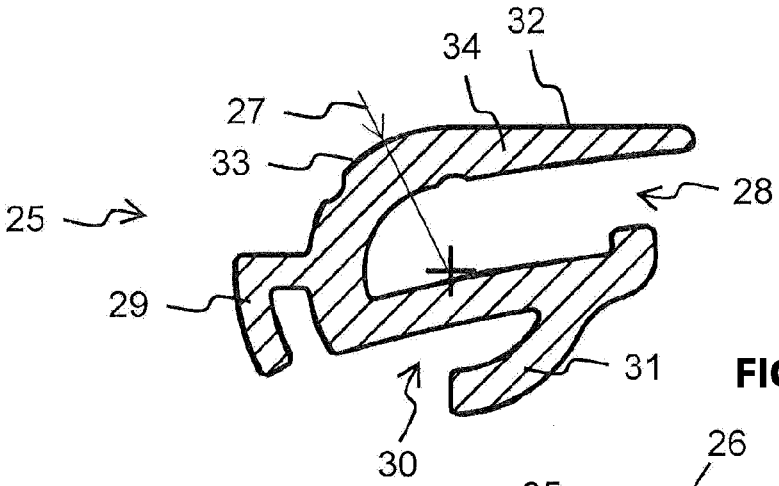
Figure 4:
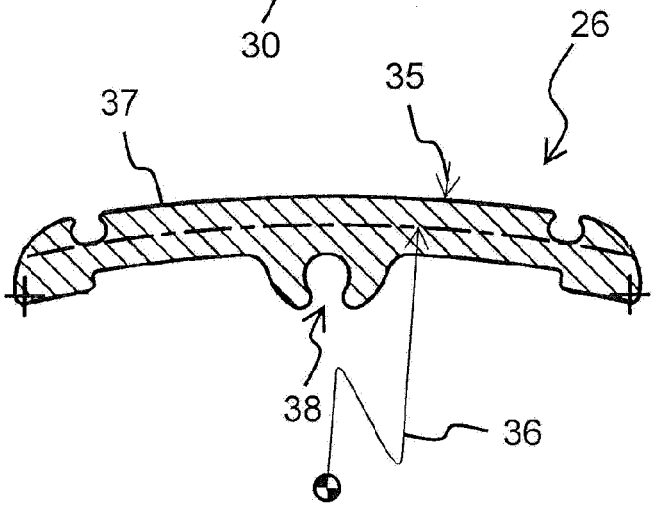

The invention will now be described in more detail based on an advantageous embodiment with reference to drawing figures, wherein:

FIG. 1 illustrates a movement gap with a gap profile according to the invention; and FIGS. 2-4 illustrate details of the gap profile according to the invention.

DETAILED DESCRPTION OF THE INVENTION

The gap profile 1 according to the invention illustrated in FIG. 1 includes two identical anchors units 2 and a bridge unit 3 between the anchor units 2 and bridges a drivable movement gap 4 in a flat surface 6 between two building elements 7 that extend parallel to one another of a building that is not illustrated in more detail, for example a bridge.

In order to mount the gap profile 1 on the surface 6 a compensation mass 9 is initially applied to the edge portions 8 proximal to the gap of the building elements 7 which in order to establish a level and load bearing support for the anchor units 2. After mounting the anchor units 2 the drivable flooring material 11, thus a mortar layer is applied eventually, wherein the mortar layer also partially covers the anchor units 2.

The anchor units 2 are mounted mirror symmetrical to a longitudinal direction 14 of the movement gap 4 on the building elements 7. Each anchor unit 2 includes a longitudinal arm 15 with a pass through bore hole 17 through which the anchor unit 2 is bolted with concrete anchor bolts 18 to the respective building element 7.

The anchor unit 2 includes a support arm 19 opposite to the pass through bore hole, wherein the support arm 19 extends the longitudinal arm 15 and the anchor unit also includes a retaining arm 20 perpendicular to the support arm 19. On the support arm 19 and the support arm 20 the anchor unit 2 is cambered concave to form a circular arc shaped joint socket 22 with a profile illustrated in FIG. 2 having a radius 23. A hook shaped undercut groove 24 is formed in the joint socket 22 in the portion of the support arm 19.

The bridge unit 3 includes two joint heads 25 and a center plate 26. The joint heads 25 are respectively provided with a circular arc shaped profile illustrated in FIG. 3 with a radius 27 and include a groove 28 that extends in longitudinal direction 14 in which groove the center plate 26 is supported so that it is moveable transversal to the longitudinal direction 14.

The joint heads 25 respectively include a hook shaped support element 29 extending in longitudinal direction 14 which engages the hook shaped groove 24 in the respective support arm 19 in mounted condition. The joint sockets 22 envelope the respective joint head 25 in a circular arc of 180° so that substantially only the support element 29 respectively engaging the groove 24 prevents a movement of the joint heads 25 relative to the respective joint socket 22 transversal to the longitudinal direction 14.

The joint heads 25 are configured S-shaped and include a recess 30 in the portion of the joint socket 22. The cut out 30 reduces the material requirements during production of the gap profile 1 according to the invention. When driving over the gap profile 1 according to the invention a load impacting a bridge unit 3 is transferred to the joint sockets 22 through a lower arm 31 of the joint heads 25.

A flat useable surface 32 of the gap profile 1 according to the invention is configured on the support arms 20 of the anchor units 2, transitions tangentially at the link surface 33 that is profiled in a circular arc and continues into a conically tapering cover portion 34 of the joint heads 25 which reaches over the center plate 26.

The center plate 26 has essentially a constant thickness 35 and is cambered in a circular arc with a radius 36. When the building elements 7 move away from one another during operations of the building and the anchor units 2 of the gap profile 1 according to the invention move away from one another, the surface 37 of the center plate 26 is moved upward.

The center plate 26 includes a central receiving element 38 into which a non illustrated grooved pin is insertable. The center plate 26 is connectable with a center plate of another gap profile through a grooved pin of this type. The connection element and the additional gap profile and its details are not illustrated.

The visible surface 39 of the gap profile 1 which is the only surface that is visible in installed condition includes a visible width 40 and is essentially mirror symmetrical to the longitudinal direction 14 in any operating condition of the gap profile 1.

REFERENCE NUMERALS AND DESIGNATIONS

1 gap profile
2 anchor unit
3 bridge unit
4 movement gap
6 surface
7 building element
8 edge portion
9 compensation mass
11 flooring material
14 longitudinal direction
15 longitudinal arm
17 pass through bore hole
18 concrete anchor
19 support arm
20 retaining arm
22 joint socket
23 radius
24 groove
25 joint head
26 center plate
27 radius
28 groove
29 support element
30 recess
31 arm
32 useable surface
33 joint surface
34 cover portion
35 thickness
36 radius
37 surface
38 receiving element
39 visible surface
40 visible width

What is claimed is:

1. A gap profile for a movement gap in a surface of a building between two parallel building elements of the building, the profile comprising:

two anchor units, each of the anchor units for anchoring on the building elements, each of the anchor units including a circular arc shaped concave joint socket configured to extend in a longitudinal direction of the movement gap and hook shaped undercut grooves in the concave joint sockets;

and a bridge unit for bridging the movement gap between the anchor units, the bridge unit including two longitudinally extending circular arc shaped convex joint heads and hook shaped support elements extending from the convex joint heads transversal to the longitudinal direction, wherein the bridge unit is pivotably linked through the convex joint heads in the concave joint sockets so that a load impacting the bridge unit perpendicular to the surface of the building is transferred through the convex joint heads into the concave joint sockets and from the anchor units into the building elements, wherein the hook shaped undercut grooves are engaged by the hook shaded support elements such that a form-locking connection is provided by the hook shaped support elements in the convex joint heads received by the hook shaped undercut grooves in the concave joint sockets, wherein the form-locking connection prevents a linear movement of the convex joint heads relative to the respective concave joint sockets transversal to the longitudinal direction, and wherein no portion of the load impacting the bridge unit perpendicular to the surface of the building is transferred from the hook shaped support elements to the anchor units.

2. The gap profile according to claim 1, wherein the joint sockets envelop the joint heads respectively in a circular arc of not more than 180°.

3. The gap profile according to claim 2, wherein the anchor units each comprise a flat useable surface and the joint heads each comprise a flat useable surface and a circular arc shaped joint surface extending therefrom, the flat useable surface mating in a tangential manner.

4. The gap profile according to claim 1, wherein the bridge unit includes a center plate that extends in the longitudinal direction, wherein each of the joint heads has a groove and the center plate is supported in the grooves extending in the longitudinal direction so that the center plate is moveable within the grooves in a linear manner transversal to the longitudinal direction.

5. The gap profile according to claim 4, wherein the center plate is cambered in a circular arc.

6. The gap profile according to claim 4, wherein each joint head comprises a cover portion which extends over the center plate and which tapers.

7. The gap profile according to claim 1, wherein a visible surface of the gap profile that is visible in an installed condition of the gap profile is mirror symmetrical to a vertical plane extending through a center of the circular arc.

* * * * *